US009340347B2

(12) United States Patent
Holford

(10) Patent No.: US 9,340,347 B2
(45) Date of Patent: May 17, 2016

(54) PACK FOR SMOKING ARTICLES

(75) Inventor: Steven Holford, Southampton (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 36 days.

(21) Appl. No.: 13/883,974

(22) PCT Filed: Sep. 30, 2011

(86) PCT No.: PCT/EP2011/067164

§ 371 (c)(1),
(2), (4) Date: May 31, 2013

(87) PCT Pub. No.: WO2012/059282

PCT Pub. Date: May 10, 2012

(65) Prior Publication Data

US 2013/0277249 A1 Oct. 24, 2013

(30) Foreign Application Priority Data

Nov. 5, 2010 (GB) ..... 1018716.9

(51) Int. Cl.
*B65D 85/10* (2006.01)
*B65D 5/54* (2006.01)

(52) U.S. Cl.
CPC ..... *B65D 85/1045* (2013.01); *B65D 5/548* (2013.01); *B65D 2101/0023* (2013.01)

(58) Field of Classification Search
CPC ..... B65D 5/0085; B65D 5/10; B65D 5/103; B65D 5/106
USPC ..... 229/102; 206/264–265
See application file for complete search history.

(56) References Cited

U.S. PATENT DOCUMENTS

| | | | | | |
|---|---|---|---|---|---|
| 2,443,428 | A * | 6/1948 | Lambert | 229/155 |
| 3,040,957 | A * | 6/1962 | Meyers | 229/228 |
| 5,678,690 | A | 10/1997 | Belvederi | |
| 6,343,691 | B1 * | 2/2002 | Focke et al. | 206/268 |
| 6,467,614 | B1 * | 10/2002 | Tallier et al. | 206/264 |

FOREIGN PATENT DOCUMENTS

| | | | |
|---|---|---|---|
| DE | 29502062 | U1 | 6/1996 |
| EP | 1724210 | A1 | 11/2006 |
| FR | 1514374 | A | 2/1968 |
| GB | 2290778 | A | 1/1996 |
| GB | 2290778 | A | 10/1996 |

OTHER PUBLICATIONS

International Search Report and Written Opinion, mailed Nov. 17, 2011, for International Application PCT/EP2011/067164, filed Sep. 30, 2011.
Written Opinion of the International Preliminary Examining Authority, mailed Dec. 14, 2012, for International Application PCT/EP2011/067164, filed Sep. 30, 2011.
International Preliminary Report on Patentability, mailed Feb. 27, 2013, for International Application PCT/EP2011/067164, filed Sep. 30, 2011.

* cited by examiner

*Primary Examiner* — Anthony Stashick
*Assistant Examiner* — Robert Poon
(74) *Attorney, Agent, or Firm* — Cantor Colburn LLP

(57) ABSTRACT

A pack for smoking articles is disclosed. The pack comprises a lid (9) and a body (2) configured to move relative to one another. The lid has a front wall (13) with a lower front wall edge (15) and a tab (20) extending from the lower front wall edge which is adhered to a front panel (3) of the body. The tab (20) includes a line of weakening (23) that is broken to initially open the pack such that at least a portion of the tab remain adhered to the front panel of the body.

5 Claims, 5 Drawing Sheets

PACK FOR SMOKING ARTICLES

CLAIM FOR PRIORITY

This application is a National Stage Entry entitled to and hereby claims priority under 35 U.S.C. §§365 and 371 to corresponding PCT Application No. PCT/EP2011/067164, filed Sep. 30, 2011, which in turn claims priority to GB Application No. 1018716.9, filed Nov. 5, 2010. The entire contents of the aforementioned applications are herein expressly incorporated by reference.

Smoking articles such as cigarettes are typically stored in packs and the overall function of the packs is to store and protect the cigarettes from mechanical and environmental damage. Various configurations of cigarette packs are known from the prior art including hinged-lid and shell packs with slidable inserts. A hinged-lid pack comprises a body and a lid so as to define a space for holding a bundle of smoking articles. The lid is attached to a rear panel of the body along a hinge-line so that it can rotate between an open and closed position. In a closed position a lower front wall edge of the lid abuts an upper edge of a front panel of the body so as to create a flush outer finish.

When a consumer purchases or receives for example a hinged-lid pack containing smoking articles, they rely on the outer cellophane wrapping and/or the inner foil wrapping to indicate as to whether the pack has previously been opened or not. However, not all packs are wrapped in cellophane and as the foil wrapping is not sealed it may not give sufficient evidence as to whether the content of the pack has been interfered or tampered with.

GB2290778A seeks to overcome the problem referred to above by providing a pack where the front wall of the lid is formed with a downwardly depending semi-circular tab. The tab is received in a complementary cut-out formed in the upper edge of the front wall of the body so that it lies against the frame received inside the pack. When the pack is assembled and the lid closed, a layer of adhesive is disposed between the tab and the frame so as to stick the tab to the frame. To initially open the pack, the adhesive must be broken so as to release the tab.

A disadvantage of the pack known from GB2290778A includes the fact that the adhesive needs to be broken which may require some force. Furthermore, the breaking of the adhesive may cause residues of the adhesive to remain on the frame causing an un-aesthetically acceptable appearance of the pack. The tab always protrudes from the front wall of the lid, even once the pack has been opened and this may also be undesirable.

The present invention seeks to provide a pack for holding smoking articles that overcomes or substantially alleviates the problems mentioned above.

According to the present invention, there is provided a pack for smoking articles comprising a first portion and a second portion configured to move relative to one another, the first portion having a front wall with a lower front wall edge and a tab extending from the lower front wall edge which is adhered to a front panel of the second portion, wherein the tab includes a line of weakening that is broken to initially open the pack such that at least a portion of the tab remain adhered to the front panel of the second portion.

Preferably, the first and second portions form a line of closure when the pack is closed and the line of weakening is coincident with said line of closure.

Alternatively, the first and second portions form a line of closure when the pack is closed and the line of weakening is misaligned relative to the line of closure.

The line of weakening may be formed below the line of closure so that when the line of weakening is broken to initially open the pack, a portion of the tab remains on both the first and the second portions.

In one embodiment, the first portion is a lid and the second portion is a body.

The lid may be formed with a flap extending from the front wall edge along a fold-line, the tab being formed by an incision in said flap, the flap being folded inwardly relative to the tab so as to lie against an inner surface of the lid.

The body may be formed with a front panel edge and an integral tab, the integral tab extends from said front panel edge of the second portion and locates in a recess formed on an inner surface of the front wall of the first portion when the pack is closed.

In an alternative embodiment, the first portion is a body and the second portion is a lid.

The tab may be semi-circular or it may be of any other shape such as rectangular or square.

Preferably, an adhesive is used to connect the tab to the front panel of the second portion.

According to another aspect of the invention, there is also a blank for forming the invention referred to above.

Embodiments of the present invention will now be described by way of example only, with reference to the accompanying drawings, in which.

Figure 1:
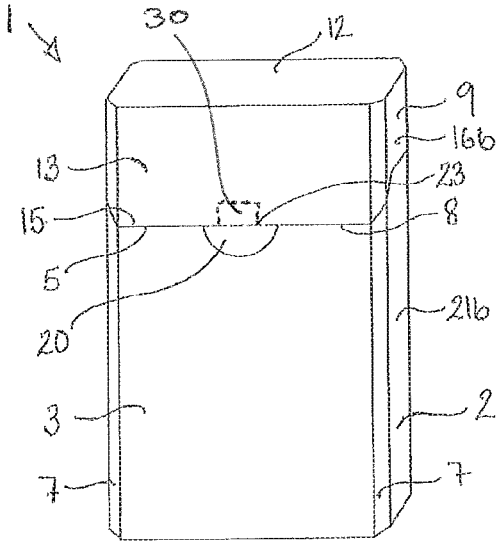
FIG. 1 shows a pack for holding a bundle of smoking articles according to the present invention.
Figure 2:
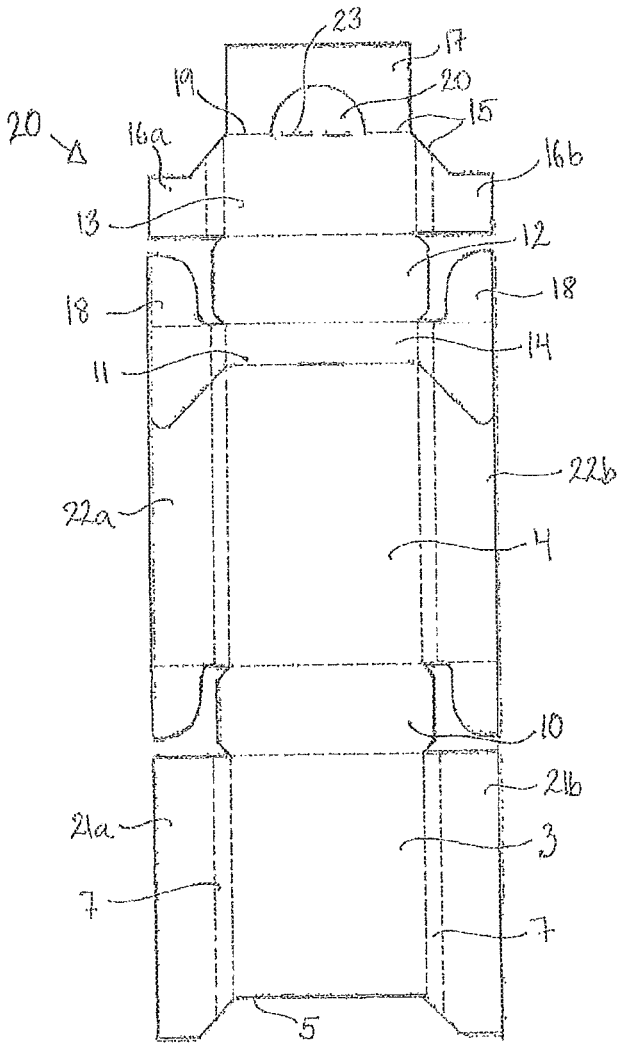
FIG. 2 shows a blank for forming the pack in FIG. 1.

Referring now to the drawings, there is shown in FIG. 1 a pack 1 for holding a bundle of smoking articles according to the present invention. FIG. 2 shows a blank 20 for forming the pack in FIG. 1 where the solid lines denote cut lines or outer borders of the blank 20 and the dashed lines denote lines which are formed by folding. The pack 1 comprises a body 2 and a lid 9. The lid 9 is formed with a tab 20 which extends from a lower front wall edge 15 along a line of weakening 23. The tab 20 provides evidence that the pack has not been interfered or tampered with prior to initially opening the pack as will become apparent from the description below.

The general configuration of the pack 1 in a folded position will now be described with reference to FIG. 1, however some features are not visible in this figure but can be identified in FIG. 2. The body 2 of the pack 1 is formed with opposing front and rear panels 3, 4 separated by two opposing left and right side panels 21*a*, 21*b* as well as a base panel 10. The corners 7 formed at the junctions of the front panel 3 and the side panels 21*a*, 21*b* may be rounded. The front 3 and side panels 21*a*, 21*b* are formed with upper edges 5 which abut corresponding lower edges 15 of the lid 9 so as to form a closure line 8. The rear panel 4 of the body is connected to a rear wall 14 of the lid 9 along a hinge-line 11. The lid 9 is further provided with a top wall 12, extending between the rear wall 14, a front wall 13 and left and right side walls 16*a*, 16*b* of the lid 9. The front 13 and side walls 16*a*, 16*b* of the lid 9 are formed with the lower edges 15 which mate with the upper edges 5 of the body 2 when the pack 1 is closed. The lid 9 is further formed with the tab 20 which depends from the lower front wall edge 15 along a line of weakening 23. The tab 20 is initially adhered to an upper surface of the front panel 3 of the body 2 by means of an adhesive. When the pack 1 is opened for the first time the line of weakening 23 is broken such that at least a portion of the tab remains on the front panel 3 of the body 2, thus the tab 20 functions as a seal in that it indicates that the pack 1 has not been interfered or tampered with prior to the initial opening of the pack 1.

In FIG. 2, it can be appreciated that the blank 20 is elongate in shape and comprises the body 2 and the lid 9 of the pack 1 described above. The body 2 of the blank 20 is formed with the front panel 3, the base panel 10 and the rear panel 4. The front panel 3 is formed with the left and right side walls 21*a*, 21*b* which overlap side flaps 22*a*, 22*b* extending from the rear panel 4 when the blank 20 is in a folded position. The dashed lines of the blank located between the front wall 3 and its side walls 21*a*, 21*b*, as shown in FIG. 2, indicate that the corners formed when the blank is folded are rounded.

The lid 9 of the blank 20 further comprises the rear wall 14, top wall 12 and the front wall 13 as previously described. The top and rear walls 12, 14 of the lid 9 are formed with side flaps 18 which are overlapped by the side walls 16*a*, 16*b* of the front wall 13 of the lid 9 when the blank 20 is in a folded position. The front wall 13 of the lid 9 is further formed with a flap 17 extending from the lower front wall edge 15 along a fold-line 19. The flap folds inwardly so that it lies against the inner surface of the front wall 13 of the lid 9. The flap 17 provides stability and strength to the lid as it together with the front wall 13 of the lid 9 form a double layer. The flap is formed with a semi-circular incision extending from the fold-line 19 so as to form the tab 20 which depends from the lower front wall edge as the flap 17 is folded inwardly. The tab 20 extends from the lower front wall edge 15 along the line of weakening 23 as previously described and the line of weakening may be formed by, for example, cutting, scoring or perforating.

It is envisaged that the line of weakening 23 is coincident with the closure line 8 between the body 2 and the lid 9 so that the tab portion remaining on the front wall 3 of the body 2 of an opened pack does not extend beyond the upper edges 5 of said body 2. Alternatively, the line of weakening 23 may be located below the closure line such that when the pack is opened portions of the tab remain on the body as well as on the lid. In yet another embodiment, the line of weakening may be formed above the closure line so that the tab portion remaining on the front panel 3 of the body 2 extends beyond the upper edges 5 of said body 2.

It should be appreciated that the tab is not limited to a semi-circular shape, and so could be of any shape and/or size. Alternative embodiments of the tab are shown in FIGS. 3 and 4 in which FIG. 3 shows a tab of a rectangular shape and FIG. 4 illustrates a smaller semi-circular shaped tab compared to that of the embodiment shown in FIGS. 1 and 2.

Figure 4:
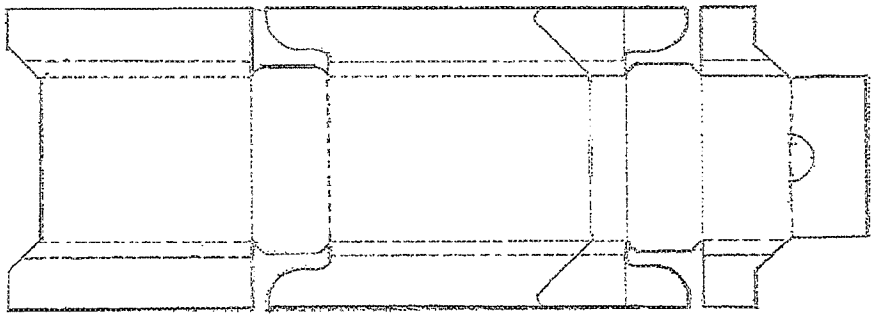
FIG. 4 shows a blank for forming yet another embodiment of the pack.
Figure 5:
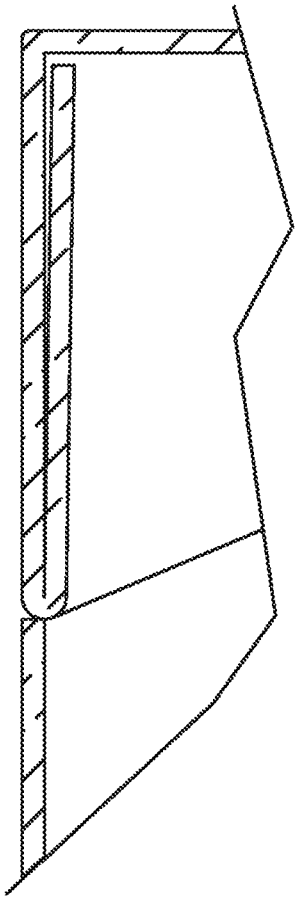
FIG. 5 shows a cross-sectional view of an embodiment of the pack.

To enhance the visual appearance of the pack complementary shapes may be drawn onto the front wall of the lid, for example, a mirror image of the semi-circle of the tabs shown in FIGS. 1 and 4 may be drawn on to the front wall of the lid so as to give a visual impression of a full circle.

Figure 3:
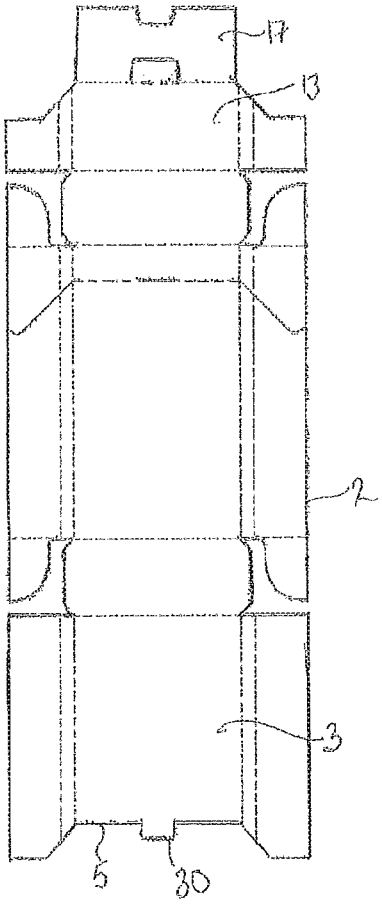
FIG. 3 shows a blank for forming an alternative embodiment of the pack.

In combination with any of the embodiments described above, the front panel 3 of the body 2 may further be formed with an integral tab 30 which extends from the upper front panel edge 5 as can appreciated from FIG. 3. When the pack is closed the integral tab 30 locates in a recess formed on the inner surface of the lid front wall 13. The recess is formed by the cut out in the flap 17 forming the tab depending from the front wall 13 of the lid 9. When the integral tab 30 locates in the recess, the stability of the pack is improved in that movements parallel to the front closure line of the pack is reduced.

In an alternative un-illustrated embodiment, the pack may be formed with a tab of a suitable shape extending from an upper edge of the panel of the body and is adhered to the front wall of the lid. The tab is also formed with a line of weakening that is broken to initially open the pack such that at least a portion of the tab remain adhered to the front wall of the lid, thus it functions similarly to the pack described with reference to FIGS. 1 to 4 and provides similar advantages. It is also envisaged that the pack may be formed with the alternative features as described above with reference to FIGS. 1 to 4. For example, the line of weakening may be coincident with the closure line or it may be formed above or below the closure line. It should also be appreciated that the pack having a tab extending from an upper edge panel of the body, may also be formed with an integral tab depending from the upper front wall edge of the lid and locates in a recess formed on an inner surface of the body front panel.

It should be understood that the configuration of the tab according to the present invention is not limited to hinged-lid packs. It is envisaged that it can be applied to various alternative packs holding smoking articles, for example shell packs.

Although embodiments of the invention have been shown and described, it will be appreciated by those persons skilled in the art that the foregoing description should be regarded as a description of preferred embodiments only and that other embodiments that fall within the scope of the appended claims are considered to form part of this disclosure.

The invention claimed is:

1. A pack for smoking articles comprising a lid and a body configured to move relative to one another and to form a line of closure when the pack is closed, the lid having a front wall with a lower front wall edge and an integral lid tab, extending from a section of the lower front wall edge which is adhered to a front panel of the body, wherein the lid is formed with a flap extending from the lower front wall edge along a fold-line, the flap being folded inwardly relative to the lid tab so as to lie against an inner surface of the lid, the flap comprising a cut-out corresponding to the lid tab, wherein the lid tab includes a line of weakening that is broken to initially open the pack such that at least a portion of the lid tab remains adhered to the front panel of the body, wherein the front wall and the front panel are substantially coplanar when the pack is closed, and wherein the line of weakening is substantially coincident with the line of closure of the pack, wherein the body is formed with a front panel edge and an integral body tab, the integral body tab extending from said front panel edge of the body and locating in a recess formed on an inner surface of the front wall of the lid when the pack is closed.

2. The pack according to claim 1, wherein the integral lid tab is formed by an incision in said flap.

3. The pack according to claim 1, wherein the integral lid tab is semi-circular.

4. The pack according to claim 1, wherein an adhesive is used to connect the integral lid tab to the front panel of the body.

5. The pack according to claim 1, wherein the cut-out defines the recess.

* * * * *